US009797049B2

(12) United States Patent
Murray et al.

(10) Patent No.: US 9,797,049 B2
(45) Date of Patent: Oct. 24, 2017

(54) SYSTEM, APPARATUS, AND METHOD OF PROVIDING CATHODIC PROTECTION TO BURIED AND/OR SUBMERGED METALLIC STRUCTURES

(71) Applicant: ELECTRIC POWER RESEARCH INSTITUTE, INC., Charlotte, NC (US)

(72) Inventors: Neal Scott Murray, Charlotte, NC (US); Tiebin Zhao, Charlotte, NC (US)

(73) Assignee: ELECTRIC POWER RESEARCH INSTITUTE, INC., Charlotte, NC (US)

( * ) Notice: Subject to any disclaimer, the term of this patent is extended or adjusted under 35 U.S.C. 154(b) by 251 days.

(21) Appl. No.: 14/623,000

(22) Filed: Feb. 16, 2015

(65) Prior Publication Data

US 2016/0237575 A1 Aug. 18, 2016

(51) Int. Cl.

| | |
|---|---|
| ***C23F 13/02*** | (2006.01) |
| ***C23F 13/16*** | (2006.01) |
| ***C23F 13/22*** | (2006.01) |
| ***C23F 13/18*** | (2006.01) |

(52) U.S. Cl.

CPC ..... *C23F 13/16* (2013.01); *C23F 13/18* (2013.01); *C23F 13/22* (2013.01); *C23F 2213/31* (2013.01); *C23F 2213/32* (2013.01)

(58) Field of Classification Search

CPC ..... C23F 13/02; C23F 13/06; C23F 13/08; C23F 13/10; C23F 13/16; C23F 13/18; C23F 13/20; C23F 2213/20; C23F 2213/30; C23F 2213/31; C23F 2213/21; C23F 13/04; C23F 13/22; C23F 2213/10

See application file for complete search history.

(56) References Cited

U.S. PATENT DOCUMENTS

| | | | | |
|---|---|---|---|---|
| 2,802,781 | A * | 8/1957 | Featherly | C23F 13/18 182/93 |
| 2,838,453 | A * | 6/1958 | Randall | B63B 59/04 182/196 |
| 4,709,120 | A * | 11/1987 | Pearson | H02B 7/08 174/16.1 |
| 5,415,745 | A | 5/1995 | Pultan et al. | |
| 5,968,339 | A * | 10/1999 | Clear | C23F 13/16 204/196.1 |
| 7,169,288 | B2 | 1/2007 | Drapeau | |
| 7,701,356 | B2 | 4/2010 | Curt et al. | |
| 7,878,058 | B2 | 2/2011 | Blendinger et al. | |
| 2012/0031750 | A1* | 2/2012 | Moghbeli | C23F 13/14 204/196.01 |
| 2014/0216945 | A1* | 8/2014 | Farris | C23F 13/005 205/726 |
| 2014/0321838 | A1* | 10/2014 | Farris | F24H 9/2021 392/441 |

* cited by examiner

*Primary Examiner* — Luan Van

*Assistant Examiner* — Alexander W Keeling

(74) *Attorney, Agent, or Firm* — Trego, Hines & Ladenheim, PLLC

(57) ABSTRACT

A system configured to provide cathodic protection to buried and/or submerged metal components and/or structures, such as pipes is disclosed. The system includes a cathodic protection apparatus having at least one upright support and a plurality of sacrificial anodes secured to the at least one upright support in a vertical orientation to provide variable cathodic protection to the metallic structures.

14 Claims, 5 Drawing Sheets

SYSTEM, APPARATUS, AND METHOD OF PROVIDING CATHODIC PROTECTION TO BURIED AND/OR SUBMERGED METALLIC STRUCTURES

BACKGROUND OF THE INVENTION

This invention relates generally to cathodic protection of metallic components and/or structures, and more particularly to a system, apparatus, and method of providing cathodic protection to buried and/or submerged metal components and/or structures, such as pipes.

Metallic structures, buried or submerged, are subject to corrosion. As a result, adequate corrosion control procedures are needed to ensure metal integrity for safe and economical operation. In many cases, material selection and coatings are the first line of defense against external corrosion. The function of an external coating is to control corrosion by isolating the external surface of the metallic structure from the environment, to reduce cathodic protection current requirements, and to improve current distribution. External coatings must be properly selected and applied and the coated metallic structures carefully handled and installed to fulfill these functions. Such coatings may provide a moisture barrier and/or electrical insulator and may include polyolefin coatings, epoxy coatings, wax, prefabricated films, and/or coal tar. Additionally, galvanization of steel is often used to protect against galvanic corrosion of metallic structures. Because perfect coatings are not feasible, cathodic protection is often used in conjunction with these coatings.

One area where corrosion of metallic structures is of particular concern is in underground vaults for power cables. These underground vaults not only include cables, but also include cable supports, grounding wires, and other metallic structures such as underground or submerged piping systems. Because the vaults are underground, periods of high humidity and condensation may occur; resulting in atmospheric corrosion and mild and/or moderate degradation of the metallic structures contained within the vaults.

Additionally, the vaults are subject to flooding conditions. If the vaults fail to drain then the vaults fill with high conductivity water and the metallic structures may be subjected to severe galvanic corrosion. Observations of existing vaults has revealed that severe corrosion may exist on metallic cable supports within the vaults after just a few years of installation.

Sump pumps are occasionally employed in vaults to remove the high conductivity water. However, sump pumps may not be effective in cases where water coming into the vaults is constant, for example from a nearby water source, since the vaults can be filled in a short time—days or even hours. Additionally, sump pumps are often disabled due to debris and contaminants that are collected within the vaults throughout the years. Further, environmental restrictions may be an issue in cases where the sump pump in the vault empties the water into the streets and storm drains.

As mentioned above, cathodic protection may be employed to aid in protecting metallic structures. In underground vaults, cathodic protection has been employed by providing a single sacrificial anode disposed at a bottom of a vault. Unfortunately, such cathodic protection is inadequate and/or inefficient in environments where water levels may change due to the current output of the anode being constant, thereby reducing protection during high water levels. Sacrificial anode cathodic protection relies upon energy released from the anode material to polarize the metallic structures within the vault. The act of polarization equalizes the anodic and cathodic sites on the structures, equipment and hardware so that the driving potential is eliminated and the corrosion is reduced or arrested. However, because the water levels within the vaults may change from vault to vault and with the seasons, the current requirements for the cathodic protection system may also change significantly.

Accordingly, there remains a need for a system, apparatus, and method of providing cathodic protection that is optimized for different moisture and/or water levels contained in an underground vault.

BRIEF SUMMARY OF THE INVENTION

This need is addressed by the present invention, which provides a system, apparatus, and method of providing variable cathodic protection to metallic structures.

According to one aspect of the invention, a system configured to provide cathodic protection to buried or submerged metallic structures includes a cathodic protection apparatus having at least one upright support and a plurality of sacrificial anodes secured to the at least one upright support in a vertical orientation to provide variable cathodic protection to the metallic structures.

According to another aspect of the invention, a system configured to provide cathodic protection to metallic structures contained in an underground vault where water levels within the vault rise and lower includes a plurality of sacrificial anodes secured to a wall of the vault, the sacrificial anodes being electrically connected to each other and arranged in a vertical orientation to provide variable cathodic protection to the metallic structures as the water level in the vault changes.

According to another aspect of the invention, a method of providing cathodic protection to a metallic structure contained in an underground vault includes the steps of providing a plurality of sacrificial anodes, securing the plurality of sacrificial anodes in the underground vault in a vertical orientation, electrically connecting the plurality of sacrificial anodes to the metallic structure to be protected, and monitoring a health of the plurality of sacrificial anodes.

BRIEF DESCRIPTION OF THE DRAWINGS

The invention may be best understood by reference to the following description taken in conjunction with the accompanying drawing figures, in which.

DETAILED DESCRIPTION OF THE INVENTION

Figure 1:
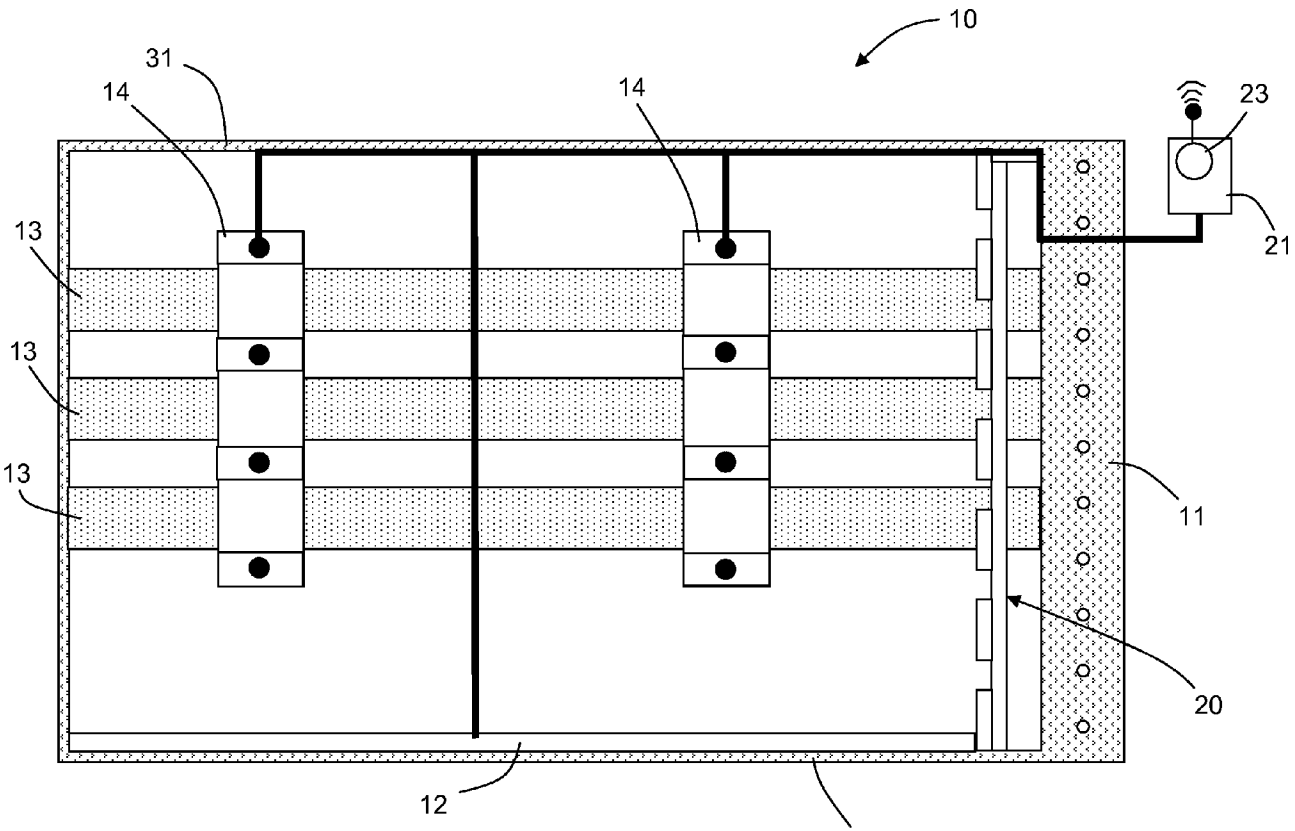
FIG. 1 shows a system according to an embodiment of the invention employed in a vault.

Referring to the drawings wherein identical reference numerals denote the same elements throughout the various views, FIG. 1 illustrates a system 10 configured for use in an underground structure. As shown, the system 10 is employed in a typical underground vault 11 for power cables. The vault 11 may be formed of concrete and includes a ground loop 12, power cables 13 running through the vault 11, and cable supports 14 configured to support the power cables 13. The system 10 includes a cathodic protection apparatus 20 electrically connected to the cable supports 14 and ground loop 12 to provide cathodic protection thereto and a terminal station 21 electrically connected to the cathodic protection apparatus 20, ground loop 12, and cable supports 14 to allow a user to obtain readings without going into the vault. The terminal station may provide data to a user on-site at the terminal or via a communications module 23 that permits the data to be transmitted wirelessly or by wire to a user.

Figure 3:
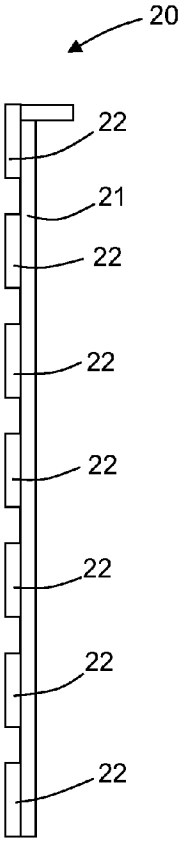
FIG. 3 is a side view of the cathodic protection apparatus of FIG. 2.
Figure 2:
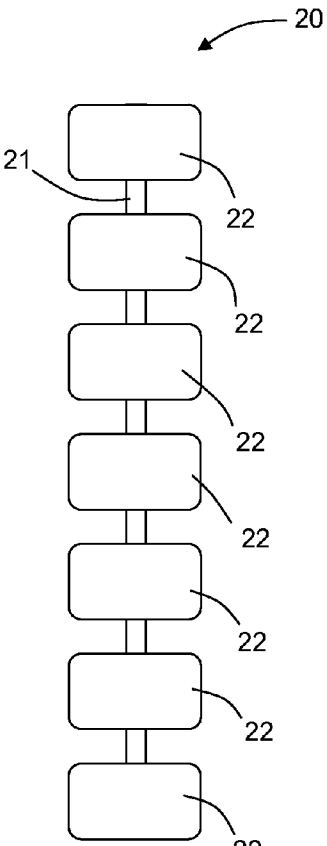
FIG. 2 is a front view of a cathodic protection apparatus used in the system of FIG. 1.

As shown in FIGS. 2 and 3, the cathodic protection apparatus 20 provides multi-level cathodic protection to buried and/or submerged metallic structures. The apparatus 20 includes a generally vertical or upright support 21 configured to support a plurality of spaced-apart sacrificial anodes 22 thereon in a ladder structure to provide multi-level or variable strength cathodic protection. As illustrated, the sacrificial anodes 22 are spaced in a vertical orientation. For purposes of this application, the term vertical orientation simply means that there is a height difference between sacrificial anodes. The sacrificial anodes 22 are electrically connected to each other and may be integrally formed with or connected to the upright support 21 and may be of the same material, same size, and provide the same protection to metallic structures or they may be of different materials, size, and protection to accommodate various environments, such as environments with dissimilar metals, etc. Example sacrificial anodes include alloys of zinc, magnesium, and aluminum.

Figure 5:
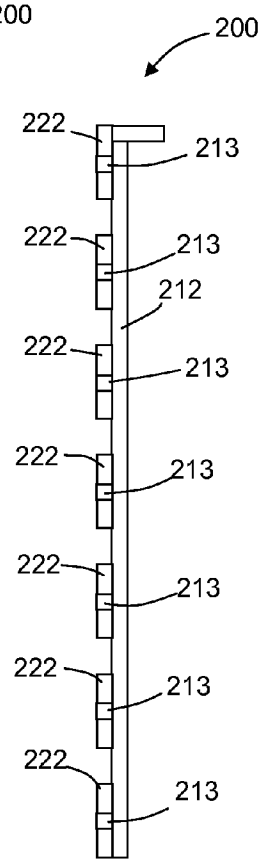
FIG. 5 a side view of the cathodic protection apparatus of FIG. 4.
Figure 4:
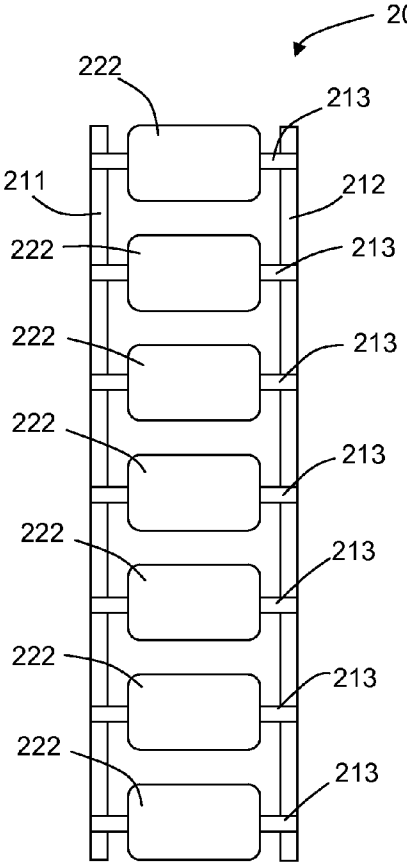
FIG. 4 is a front view of a cathodic protection apparatus used in the system of FIG. 1.

Optionally, the system 10 may include a cathodic protection apparatus 200, as illustrated in FIGS. 4 and 5. Like cathodic protection apparatus 20, cathodic protection apparatus 200 provides a ladder structure. Cathodic protection apparatus 200 includes a pair of spaced-apart generally vertical or upright supports 211 and 212 interconnected by a plurality of spaced-apart rungs 213 extending therebetween to form a ladder-type structure. At least one sacrificial anode 222 is secured to or integrally formed with each rung 213 to provide variable cathodic protection. Each of the sacrificial anodes 222 are electrically connected to each other and spaced in a vertical orientation. It should be appreciated, that the cathodic protection apparatuses 20 and 200 may take various forms or be of various structural designs (e.g. anodes are directly secured to a wall of the vault 11 instead of an upright support) so long as the sacrificial anodes are in a vertical orientation to provide variable protection to the metallic structures contained in vault 11. It should also be appreciated that the upright supports 21, 211, and 212 as well as rungs 213 may also be made of an anode material if design conditions permit. Preferably, the upright supports 21, 211, and 212 rungs 213 are made of a material capable of withstanding the environment within vault 11 during a design life of the sacrificial anodes 22 and 222.

As illustrated in FIGS. 1-7, cathodic protection apparatuses 20 and 200 include seven sacrificial anodes integrally formed with or connected thereto. It should be appreciated that the number of sacrificial anodes 22 and 222 used is variable. In general, the total number of sacrificial anodes is determined by the application in which the cathodic protection apparatuses 20 and 200 are used. The capacity, material, and design of each sacrificial anode can be all the same or varied based on the corrosion protection requirements, metallic components and/or structures and surface areas to be protected at different water levels within the vault 11. The design may also optimize the life span of each sacrificial anode for maintenance and replacement. For instance, a sacrificial anode near a floor 30 of the vault 11 may be designed differently from a sacrificial anode near a ceiling 31 of the vault 11, since the anode near the floor 30 may be of more active duty and therefore consumed faster than the anode near the ceiling 31.

The terminal station 21 is located outside of the vault 11 to allow an individual to obtain readings without going into the vault 11. Such external access to instrumentation precludes the need for inspection crews to enter the confined space of the vault 11. Communication protocols and power supplies may also be supplied to allow a user to remotely monitor events within the vault 11. Sensors to monitor water levels, outputs of the anodes, and polarization levels may also be employed.

For purposes of clarity, only cathodic protection apparatus 20 will be discussed below. Moving the electrical connections of the sacrificial anodes 22 to the terminal station 21 outside of the vault 11 allows personnel to measure the polarization levels and current output of the cathodic protection apparatus 20. This allows maintenance personnel to confirm that the polarization levels meet criteria but also understand when the cathodic protection apparatus 20 requires maintenance. A simple potential measurement eliminates opening the vault 11, purging the air, and entering a confined space. This eliminates large crews, logistics for equipment, and possible outages due to inspections. Additionally, by using the communications module 23, on-line communications, such as alarming at various water levels and requirements for cathodic protection apparatus 20 refurbishment may be transmitted to a remote site.

Figure 6:
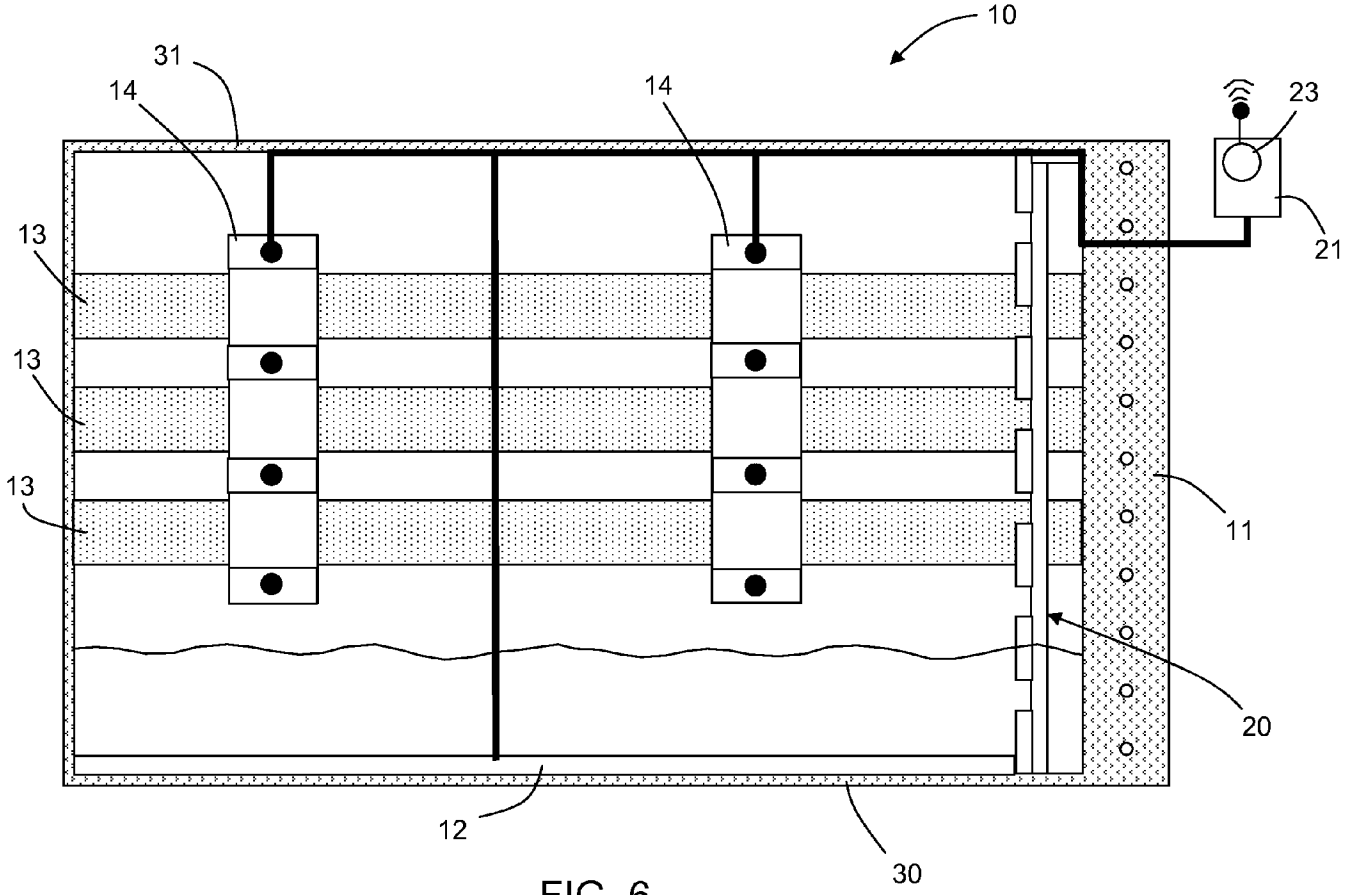
FIG. 6 illustrates the system of FIG. 1 when a water level in the vault is low.
Figure 7:
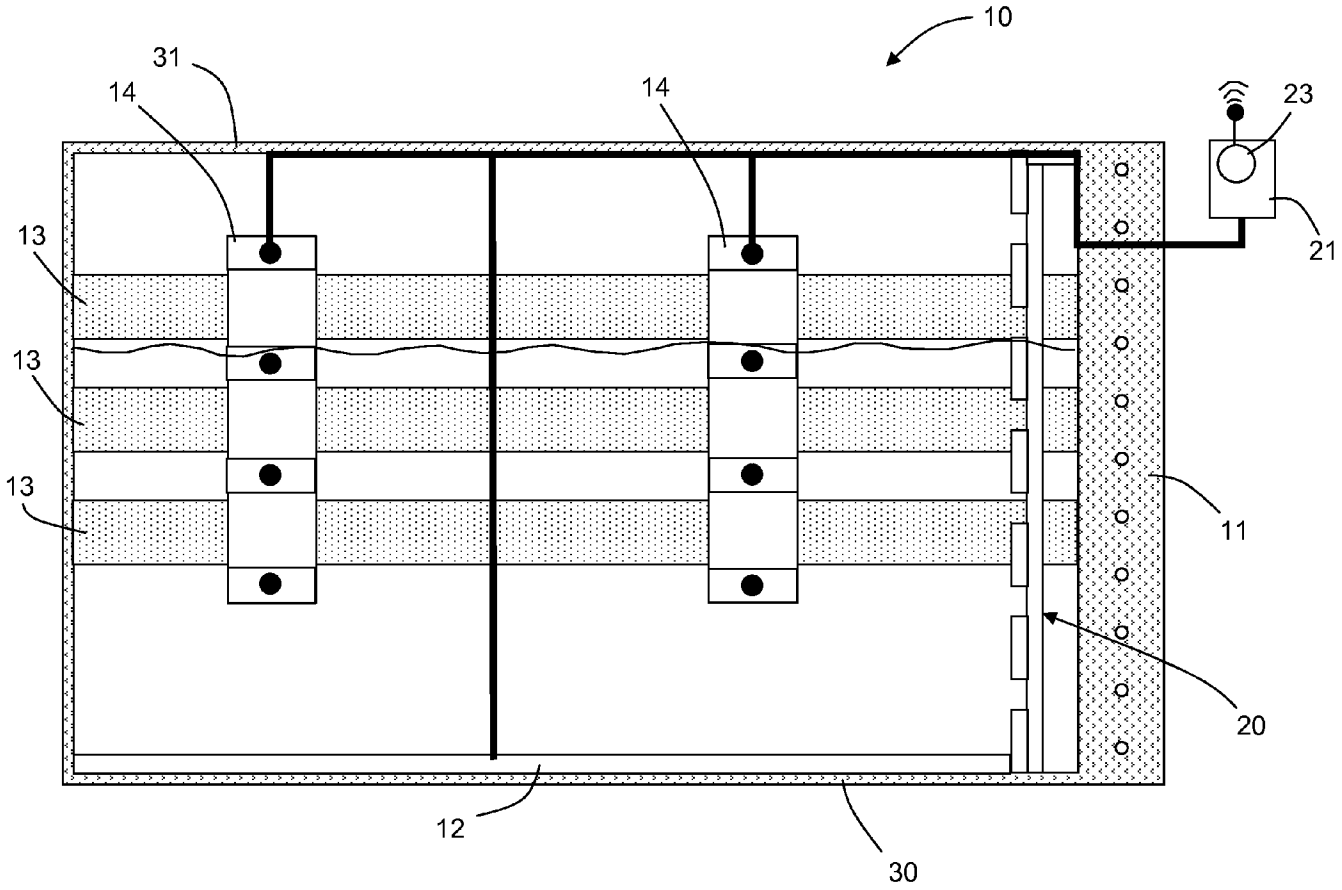
FIG. 7 illustrates the system of FIG. 1 when a water level in the vault is high.

As illustrated in FIG. 6, when the water level within the vault 11 is low, only a portion of the total number of sacrificial anodes 22 are effective in providing cathodic protection to the submerged metallic structures (i.e., grounding loop). As the water level rises (FIG. 7), the vertical orientation of the cathodic protection apparatus 20 provides additional sacrificial anodes 22 to protect the additional metallic structures now subjected to corrosion by the rising water level. In other words, the current output of the cathodic protection apparatus 20 changes with water level changes in the vault 11.

Figure 8:
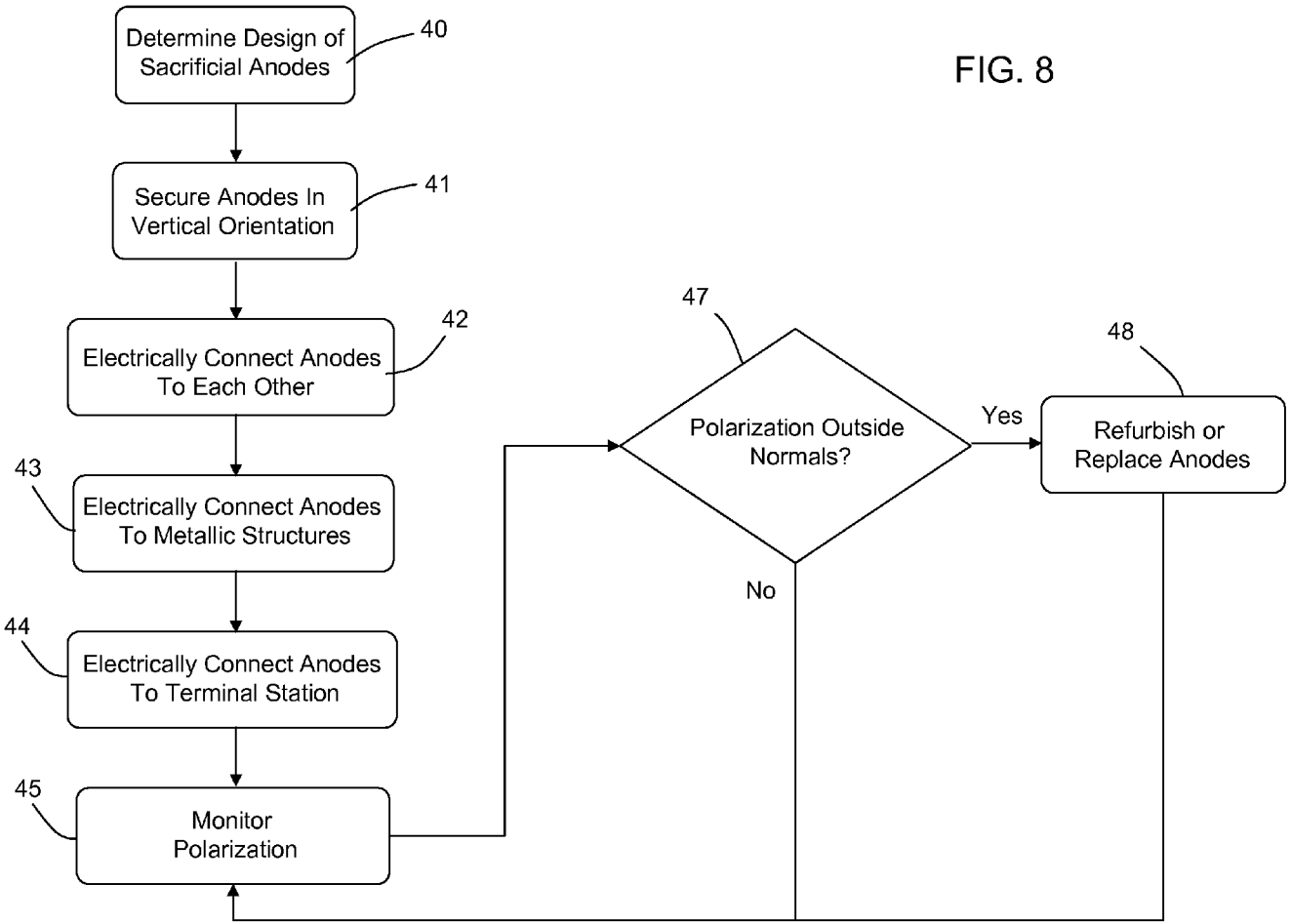
FIG. 8 is a block diagram illustrating a method of providing cathodic protection to underground and/or submerged metallic structures.

Referring to FIG. 8, in use, the design and number of the sacrificial anodes is determined, block 40. The design takes into consideration the type/material, capacity/size, and number of sacrificial anodes needed for the conditions present in the vault 11. For example, are there dissimilar metals present and at what height within the vault 11 are they located, what is the moisture levels in the vault 11, does the vault 11 often flood, etc. In the case of dissimilar metals, sacrificial anodes of different alloys may be needed and certain alloys may need to be at a different height than other alloys. If the vault 11 floods regularly, the size and capacity of the sacrificial anodes may need to be adjusted. In other words, the design takes into account not only the number of sacrificial anodes needed but also what materials the anodes are made of and what order or height within a vertical orientation they are placed.

Once the design is finished, block 40, a plurality of sacrificial anodes 22 are secured in the vault 11 in the pre-determined vertical orientation and arrangement, i.e., at different heights and order, block 41. The sacrificial anodes 22 are electrically connected to each other, block 42, and electrically connected to metallic structures, block 43, within the vault that need cathodic protection (For Example: supports 14, ground loop 12). Additionally, the sacrificial anodes 22 are electrically connected to the terminal station 22, block 44, to permit a user to monitor polarization levels, block 45. The user or operator can monitor the polarization levels at the terminal station 21 or can have the terminal station transmit the data to a remote site for monitoring. The user checks to see if the polarization levels are outside of a normal value, block 47. If the polarization levels indicate that the values are outside of a normal range, the user replaces the sacrificial anodes 22, block 48, and then returns to monitoring the polarization levels. If the values are not outside of a normal value range, then the user continues monitoring, block 45.

The foregoing has described a system, apparatus, and method for providing cathodic protection to buried and/or submerged metallic structures. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends any novel one, or any novel combination, of the features disclosed in this specification (including any accompanying claims, abstract and drawings), or to any novel one, or any novel combination, of the steps of any method or process so disclosed.

What is claimed is:

1. A system configured to provide cathodic protection to buried or submerged metallic structures, comprising a cathodic protection apparatus having at least one upright support and a plurality of sacrificial anodes of different capacities and alloys secured to the at least one upright support in a vertical orientation, wherein the sacrificial anodes are arranged along the upright support by capacity and alloy such that variable cathodic protection of metallic structures is achieved.

2. The system of claim 1, wherein the cathodic protection apparatus includes two spaced-apart upright supports interconnected by a plurality of rungs extending therebetween.

3. The system of claim 2, wherein each of the plurality of sacrificial anodes is secured to a respective one of the plurality of rungs.

4. The system of claim 3, wherein the plurality of sacrificial anodes are integrally-formed with the plurality of rungs.

5. The system of claim 1, wherein the at least one upright support is a sacrificial anode.

6. The system of claim 1, further including a terminal station electrically connected to the cathodic protection apparatus to provide a user with data indicative of a health of the cathodic protection apparatus.

7. The system of claim 6, wherein the terminal station transmits data to a remote monitoring station.

8. A system configured to provide cathodic protection to metallic structures contained in an underground vault where water levels within the vault rise and lower, the system comprises a plurality of sacrificial anodes of different capacities and alloys secured to a wall of the vault, the sacrificial anodes being electrically connected to each other and arranged in a vertical orientation by capacity and alloy such that variable cathodic protection to the metallic structures in the vault is provided as the water level in the vault changes.

9. The system of claim 8, wherein the plurality of sacrificial anodes are electrically connected to the metallic structures contained in the vault to provide cathodic protection to the metallic structures.

10. The system of claim 8, wherein the plurality of sacrificial anodes are electrically connected to a ground loop of the vault.

11. The system of claim 8, further including a terminal station electrically connected to the plurality of sacrificial anodes to provide a user with remote monitoring of a health of the plurality of sacrificial anodes.

12. A method of providing cathodic protection to a metallic structure contained in an underground vault, comprising the steps of:

(a) providing a plurality of sacrificial anodes of different capacities and alloys;

(b) securing the plurality of sacrificial anodes in the underground vault in a vertical orientation and arranging the plurality of sacrificial anodes based on capacity and alloy to provide variable cathodic protection to metallic structures of dissimilar metals;

(c) electrically connecting the plurality of sacrificial anodes to the metallic structure to be protected; and (d) monitoring a health of the plurality of sacrificial anodes.

13. The method of claim 12, further including the step of evaluating environmental conditions in the underground vault to determine the proper sacrificial anodes to provide.

14. The method of claim 12, further including the step of refurbishing or replacing the plurality of sacrificial anodes when the health of the plurality of sacrificial anodes deteriorates.

* * * * *